US005154266A

United States Patent [19]

Bieber et al.

[11] Patent Number: 5,154,266

[45] Date of Patent: Oct. 13, 1992

[54] LUGGAGE WITH MESH FABRIC INTERNAL PANEL

[75] Inventors: David Bieber, East Greenwich, R.I.; Shaumin Liu, Portsmouth, Va.

[73] Assignee: American Tourister, Inc., Batesville, Ind.

[21] Appl. No.: 770,907

[22] Filed: Oct. 4, 1991

[51] Int. Cl.[5] ..... A45C 5/02; A45C 5/12; A45C 13/00

[52] U.S. Cl. ..... 190/109; 190/112; 383/103; 383/106; 383/117

[58] Field of Search ..... 190/109, 111, 110, 103, 190/903, 127, 100, 112; 383/102, 105, 106, 117; 206/278.1, 287.1, 315.1

[56] References Cited

U.S. PATENT DOCUMENTS

| | | | |
|---|---|---|---|
| 1,938,519 | 12/1933 | Deffenbaugh | 190/109 X |
| 2,170,379 | 8/1939 | Ortt | 383/102 X |
| 4,156,446 | 5/1979 | Nathan | 383/106 X |
| 4,736,239 | 4/1988 | King | 206/287.1 |
| 4,753,342 | 6/1988 | Pulichino et al. | 206/287.1 |
| 4,773,515 | 9/1988 | Kotkins, Jr. | 190/111 X |
| 4,781,278 | 11/1988 | Sadow | 190/127 X |
| 4,887,751 | 12/1989 | Lehman | 190/103 X |
| 4,925,021 | 5/1990 | Pulichiano, Jr. | 190/903 X |
| 4,942,948 | 7/1990 | Vickers | 190/109 X |
| 4,998,603 | 3/1991 | Nordstrom | 206/287.1 X |
| 5,054,589 | 10/1991 | Bomes | 190/111 X |

*Primary Examiner*—Sue A. Weaver
*Attorney, Agent, or Firm*—Wood, Herron & Evans

[57] ABSTRACT

Luggage has outside walls forming a container. A two-dimensional mesh fabric is stitched all the way around its perimeter to the interior of the luggage, thereby dividing the luggage into two compartments. Panels are formed in the outside walls for access into each compartment.

2 Claims, 1 Drawing Sheet

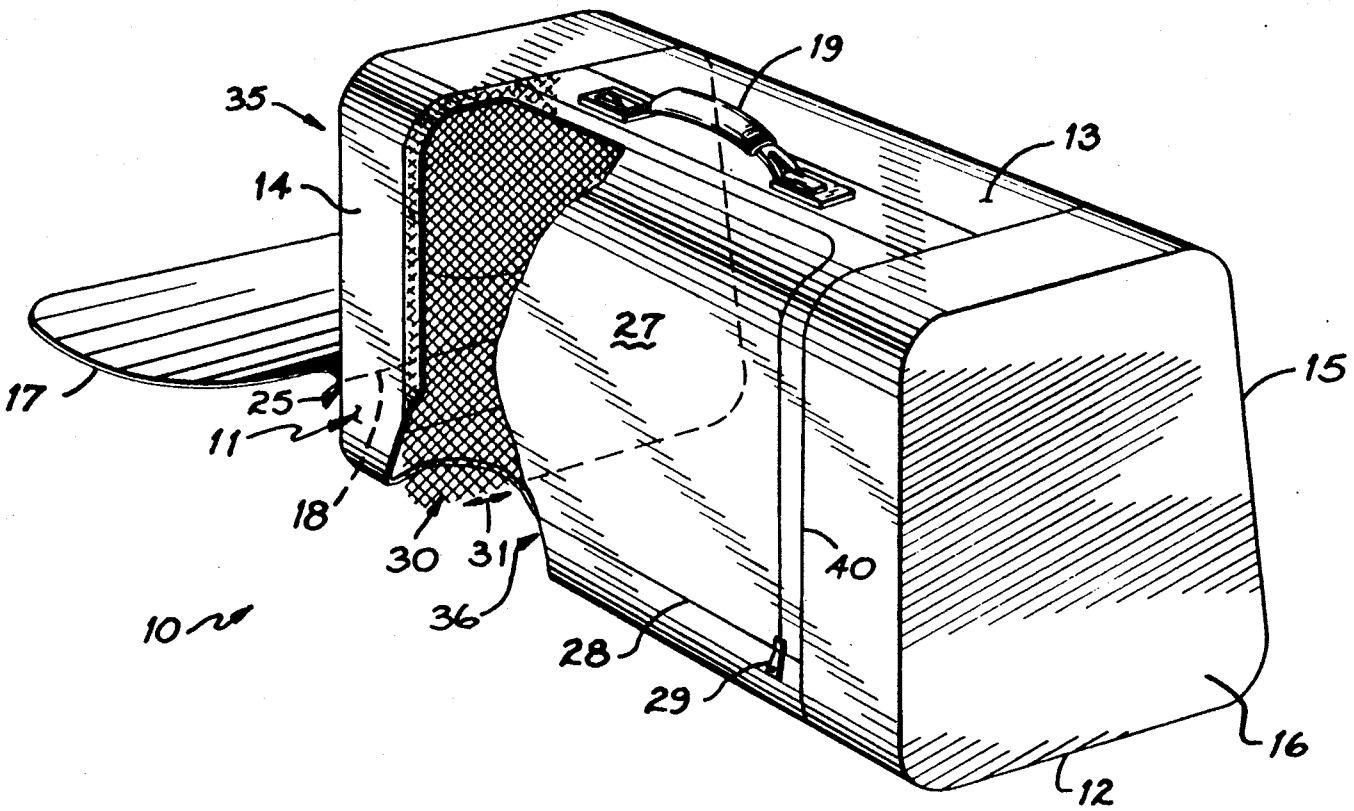
15
16
12
13
40
19
29
27
28
31
36
30
18
25
11
35
14
17
10

LUGGAGE WITH MESH FABRIC INTERNAL PANEL

This invention relates to luggage, and more particularly, to the panel that divides the luggage into two or more compartments. The invention is particularly applicable to soft-sided luggage, although it could have application to hard-sided luggage as well.

It is conventional for a piece of luggage to have one or more internal panels that divide the luggage into two or more individual compartments. These panels have been opaque The present invention improves upon the luggage of prior art in that it provides mesh panels to divide the luggage into compartments. Access panels are provided in the outside wall of the luggage for access to each compartment The advantages of the invention are that the substitution of mesh for solid, opaque panels significantly reduces the weight of the luggage because the mesh panels are extremely lightweight. While lightweight, the mesh panels are nevertheless very strong Further, and more importantly, one can see through the mesh panels, thereby keeping the user very organized. If the user has opened one compartment, he or she can see through the mesh to the other compartment so as to see what is there and where it is positioned in the compartment. The luggage walls are more like an integrated, organized single unit than two separate unrelated compartments, as is the present practice The features of the present invention will become more readily apparent from the following detailed description taken in conjunction with the accompany drawing which is a diagrammatic, perspective view partly in section of the invention.

As shown in the drawing, luggage 10 has an outside wall 11 formed by a bottom wall 12, a top wall 13, a front wall 14, a back wall 15, an end wall 16 and an access panel 17. A handle 19 is mounted on the top wall 13 for carrying the luggage. The luggage is preferably soft-sided, being formed of fabric for the most part. The panel 17 is hinged to the bottom wall at 18 and has a slide fastener connection 25 to the outside wall, thereby forming an access panel. The front wall 14 has a panel 27 which is hinged at 28 to the front wall. The slide fastener connection 29 around the free perimeter of panel 27 connects the panel to the front wall so that the panel 27 is used for access into the luggage A two-dimensional, single ply mesh fabric panel 30 has a perimeter 31. The panel 30 is stitched around the entire perimeter 31 to the outside walls of the container. More particularly, the panel is stitched to the top, bottom, front and back walls. The panel 30 divides the luggage into a first compartment 35 and a second compartment 36. Access to the first compartment is obtained by unzipping the slide fastener 25 on the panel 17 and folding it down as shown in the drawing. Access to the compartment 36 is had by unzipping the slide fastener 29 and pulling the panel 27 away from the outside wall to create an opening into the compartment 36.

A three-compartment bag could be formed by stitching a mesh fabric across the opposite end portion of the bag along line 40 and by changing end wall 16 into a zippered panel substantially identical to panel 17. Other variations will become apparent to those skilled in the art.

When the compartment 36 is opened, the user can look through the access opening and see not only into compartment 36 but also into compartment 35 through the mesh panel 30. Similarly, if the end panel is open and folded down, the user can see into both compartments 35 and 36, the view to compartment 36 being obtained through the mesh panel 30.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. Luggage comprising:

outside walls forming a closed container having lengthwise and widthwise dimensions, at least one mesh fabric panel inside said container oriented generally transversely to one of said dimensions of said container, said mesh fabric panel having a peripheral edge stitched in its entirety to the interior of said walls to form, within said luggage, at least two distinct compartments, and an access panel to each compartment formed in said outside walls.

2. Luggage comprising:

a container formed by a top wall, a bottom wall, a front wall, a back wall, and an end wall at one end of the container, a panel, parallel to said end wall, at the other end of the container and means for hingedly connecting said panel to said container, a mesh panel parallel to said end wall and having a perimeter stitched in its entirety to said top wall, bottom wall, front wall and back wall, said mesh panel being being spaced inwardly from said hinged panel to form a compartment, and an access panel is said front wall between said mesh panel and said end wall.

* * * * *